US007195695B2

(12) United States Patent
Sears et al.

(10) Patent No.: US 7,195,695 B2
(45) Date of Patent: Mar. 27, 2007

(54) CROSS-LINKED CELLULOSE FIBERS AND METHOD OF MAKING SAME

(75) Inventors: Karl D. Sears, Jesup, GA (US); W. Jason Cooper, Baxley, GA (US); Tina R. Murguia, Richmond Hill, GA (US)

(73) Assignee: Rayonier Products & Financial Services Company, Fernandina Beach, FL (US)

( * ) Notice: Subject to any disclaimer, the term of this patent is extended or adjusted under 35 U.S.C. 154(b) by 342 days.

(21) Appl. No.: 10/677,811

(22) Filed: Oct. 2, 2003

(65) Prior Publication Data

US 2005/0072542 A1 Apr. 7, 2005

(51) Int. Cl.

| | |
|---|---|
| ***D21C 9/00*** | (2006.01) |
| ***D21H 17/15*** | (2006.01) |
| ***D21H 17/64*** | (2006.01) |
| ***D21H 23/22*** | (2006.01) |
| ***D06M 11/38*** | (2006.01) |

(52) U.S. Cl. ..... 162/181.4; 162/90; 162/164.1; 162/184; 162/158; 8/116.1; 8/125; 8/493

(58) Field of Classification Search ..... 162/181.4, 162/90, 164.1, 184, 158; 8/125, 116.1, 493
See application file for complete search history.

(56) References Cited

U.S. PATENT DOCUMENTS

| | | | | |
|---|---|---|---|---|
| 3,526,048 | A | 9/1970 | Rowland et al. | |
| 3,932,209 | A | 1/1976 | Chatterjee | |
| 4,082,500 | A | 4/1978 | Ward et al. | |
| 4,399,275 | A | 8/1983 | Sears | |
| 4,608,305 | A | 8/1986 | Presto | |
| 4,820,307 | A | 4/1989 | Welch et al. | |
| 4,936,865 | A | 6/1990 | Welch et al. | |
| 4,975,209 | A | 12/1990 | Welch et al. | |
| 5,137,537 | A | 8/1992 | Herron et al. | |
| 5,139,530 | A | 8/1992 | Blanchard et al. | |
| 5,183,707 | A | 2/1993 | Herron et al. | |
| 5,190,563 | A | 3/1993 | Herron et al. | |
| 5,221,285 | A | 6/1993 | Andrews et al. | |
| 5,549,791 | A | 8/1996 | Herron et al. | |
| 5,720,737 | A * | 2/1998 | Hamajima et al. | 604/378 |
| 5,755,828 | A | 5/1998 | Westland | |
| 5,789,326 | A | 8/1998 | Hansen et al. | |
| 5,834,095 | A | 11/1998 | Dutkiewicz et al. | |
| 5,981,739 | A | 11/1999 | Anderson et al. | |
| 5,998,511 | A | 12/1999 | Westland et al. | |
| 6,068,619 | A | 5/2000 | Hamajijma et al. | |
| 6,120,888 | A | 9/2000 | Dolsey et al. | |
| 6,165,919 | A | 12/2000 | Yang | |
| 6,184,271 | B1 * | 2/2001 | Westland et al. | 524/13 |
| 6,248,879 | B1 | 6/2001 | Anderson et al. | |
| 6,264,791 | B1 | 7/2001 | Sun et al. | |
| 6,620,293 | B2 * | 9/2003 | Sears et al. | 162/157.6 |
| 6,620,865 | B2 * | 9/2003 | Westland et al. | 524/13 |
| 2002/0112296 | A1 * | 8/2002 | Graef et al. | 8/115.51 |
| 2004/0074616 | A1 * | 4/2004 | Sears et al. | 162/9 |

OTHER PUBLICATIONS

Webster's II New Riverside University Dictionary, The Riverside Publishing Company, 1988, p. 292.*

* cited by examiner

*Primary Examiner*—Eric Hug
*Assistant Examiner*—Dennis Cordray
(74) *Attorney, Agent, or Firm*—Kramer Levin Naftalis & Frankel LLP

(57) ABSTRACT

The invention provides a method for preparing cross-linked cellulosic fibers. A sheet of cellulosic fibers treated with a caustic solution under non-mercerizing conditions is cross-linked with a solution containing polymeric polycarboxylic acid cross-linking agents. The treated cellulosic fibrous material is dried and cured in sheet form to promote intrafiber cross-linking. Cross-linked fiber products of this method, which is economic, that possess good absorption and wet resiliency properties are also disclosed.

49 Claims, No Drawings

CROSS-LINKED CELLULOSE FIBERS AND METHOD OF MAKING SAME

This invention relates to cross-linked cellulose pulp sheets with excellent absorbency and wet resiliency properties. More particularly, this invention relates to the cross-linking of cellulosic pulp fibers in sheet form, the fibers having been treated with caustic under non-mercerizing conditions. This invention also relates to a method of making cross-linked cellulose pulp sheets from fibers which were treated with caustic under non-mercerizing conditions, the sheets having performance properties which are equivalent or superior to those comprised of fibers which are mercerized and cross-linked in sheet form or in fluff or individualized fiber form.

BACKGROUND OF THE INVENTION

Within the specialty paper and absorbent hygiene markets there is a growing need for affordable, high porosity, high bulk, and high absorbency pulps with superior wet resiliency to resist collapse when the fibers are in contact with fluids. The filter, towel, and wipe industries particularly require a sheet or roll product having good porosity, absorbency and bulk, which is able to retain those properties even when wet pressed. A desirable sheet product should also have a permeability which enables gas or liquid to readily pass through.

Commonly, cellulose fibers are cross-linked in individualized form to impart advantageous properties such as increased absorbency, bulk and resilience to structures containing the cross-linked cellulose fibers.

I. Cross-linking Agents

Cross-linked cellulose fibers and methods for their preparation are widely known. Common cellulose cross-linking agents include aldehyde and urea-based formaldehyde addition products. See, for example, U.S. Pat. Nos. 3,224,926; 3,241,533; 3,932,209; 4,035,147; and 3,756,913. Because these commonly used cross-linkers, such as DMDHEU (dimethyloldihydroxy ethylene urea) or NMA (N-methylol acrylamide), can give rise to formaldehyde release, their applicability to absorbent products that contact human skin (e.g., diapers) has been limited by safety concerns. Moreover, formaldehyde, which persists in formaldehyde cross-linked products, is a known health hazard and has been listed as a carcinogen by the EPA.

Carboxylic acids have also been used for cross-linking. For example, European Patent Application EP 440,472 discloses utilizing carboxylic acids, such as citric acid, as wood pulp fiber cross-linkers. For cross-linking cellulose pulp fibers, other polycarboxylic acids, i.e., $C_2$–$C_9$ polycarboxylic acids, specifically 1,2,3,4-butane tetracarboxylic (BCTA) or a 1,2,3-propane tricarboxylic acid, preferably citric acid, are described in EP 427,317 and U.S. Pat. Nos. 5,183,707 and 5,190,563. U.S. Pat. No. 5,225,047 describes applying a debonding agent and a cross-linking agent of polycarboxylic acid, particularly BCTA, to slurried or sheeted cellulose fibers. Unlike citric acid, 1,2,3,4-butane tetracarboxylic acid is considered too expensive for use on a commercial scale.

Cross-linking with polyacrylic acids is disclosed in U.S. Pat. No. 5,549,791 and WO 95/34710. Described therein is the use of a copolymer of acrylic acid and maleic acid with the acrylic acid monomeric unit predominating.

Generally, "curing" refers to covalent bond formation (i.e., cross-link formation) between the cross-linking agent and the fiber. U.S. Pat. No. 5,755,828 discloses using both a cross-linking agent and a polycarboxylic acid under partial curing conditions to provide cross-linked cellulose fibers having free pendent carboxylic acid groups. The free carboxylic acid groups improve the tensile properties of the resulting fibrous structures. The cross-linking agents include urea derivatives and maleic anhydride. The polycarboxylic acids include, e.g., acrylic acid polymers and polymaleic acid. The cross-linking agent in U.S. Pat. No. 5,755,828 has a cure temperature of about 165° C. The cure temperature must be below the cure temperature of the polycarboxylic acids so that, through only partial curing, uncross-linked pendent carboxylic acid groups are provided. The treated pulp is defiberized and flash dried at the appropriate time and temperature for curing.

Intrafiber cross-linking and interfiber cross-linking have different applications. WO 98/30387 describes esterification and cross-linking of cellulosic cotton fibers or paper with maleic acid polymers for wrinkle resistance and wet strength. These properties are imparted by interfiber cross-linking. Interfiber cross-linking of cellulose fibers using homopolymers of maleic acid and terpolymers of maleic acid, acrylic acid and vinyl alcohol is described by Y. Xu, et al., in the Journal of the Technical Association of the Pulp and Paper Industry, TAPPI JOURNAL 81(11): 159–164 (1998). However, citric acid proved to be unsatisfactory for interfiber cross-linking. The failure of citric acid and the success of polymaleic acid in interfiber cross-linking shows that each class of polymeric carboxylic acids is unique and the potential of a compound or polymer to yield valuable attributes of commercial utility cannot be predicted. In U.S. Pat. No. 5,427,587, maleic acid containing polymers are similarly used to strengthen cellulose substrates. Rather than intrafiber cross-linking, this method involves interfiber ester cross-linking between cellulose molecules. Although polymers have been used to strengthen cellulosic material by interfiber cross-linking, interfiber cross-linking generally reduces absorbency.

Another material that acts as an interfiber cross-linker for wet strength applications, but performs poorly as a material for improving absorbency via intrafiber cross-linking is an aromatic polycarboxylic acid such as ethylene glycol bis (anhydrotrimellitate) resin described in WO 98/13545.

One material known to function in both applications (i.e., both interfiber cross-linking for improving wet-strength, and intrafiber cross-linking for improved absorbent and high bulk structures) is 1,2,3,4-butane tetracarboxylic acid. However, as mentioned above, it is presently too expensive to be utilized commercially.

Other pulps used for absorbent products include flash dried products such as those described in U.S. Pat. No. 5,695,486. This patent discloses a fibrous web of cellulose and cellulose acetate fibers treated with a chemical solvent and heat cured to bond the fibers. Pulp treated in this manner has high knot content and lacks the solvent resiliency and absorbent capacity of a cross-linked pulp.

Flash drying is unconstrained drying of pulps in a hot air stream. Flash drying and other mechanical treatments associated with flash drying can lead to the production of fines. Fines are shortened fibers, e.g., shorter than 0.2 mm, that will frequently cause dusting when the cross-linked product is used.

II. Processes in Cross-linking Cellulose Fibers

There are generally two different types of processes involved in treating and cross-linking pulps for various applications. In one approach, fibers are cross-linked with a cross-linking agent in individualized fiber or fluff form to promote intrafiber cross-linking. Another approach involves interfiber linking in sheet, board or pad form.

U.S. Pat. No. 5,998,511 discloses processes (and products derived therefrom) in which the fibers are cross-linked with polycarboxylic acids in individualized fiber form. The cellulosic material is defiberized using various attrition devices so that it is in substantially individualized fibrous form prior to cross-linking of the chemical and the cellulose fibers via intrafiber bonds rather than interfiber bonds.

Mechanical defiberization has certain advantages. In specialty paper applications, "nits" are hard fiber bundles that do not come apart easily even when slurried in wet-laid operations. This process, in addition to promoting individualized fibers which minimize interfiber bonding during the subsequent curing step (which leads to undesirable "nits" from the conventional paper pulps used in this technology), also promotes curling and twisting of the fibers which when cross-linked stiffens them and thereby results in more open absorbent structures which resist wet collapse and leads to improved performance (e.g., in absorbent and high porosity applications).

However, even when substantially well defibered prior to cross-linking, in specialty paper applications "nits" can still be found in the finished product after blending with standard paper pulps to add porosity and bulk. When "nits" are cross-linked in this form, they will not come apart.

Despite the advantages offered by the cross-linking approach in individualized form, many product applications (e.g., particularly in wet-laid specialty fiber applications) require undesirable "nits" and "knots" to be minimized as much as possible. Knots differ from "nits" as they are fiber clumps that will generally not come apart in a dry-laid system, but will generally disperse in a wet laid system. Therefore, there is a need in the art to further minimize undesirable "nits" and "knots".

Interfiber cross-linking in sheet, board or pad form, on the other hand, also has its place. In addition to its low processing cost, the PCT patent application WO 98/30387 describes esterification and interfiber cross-linking of paper pulp with polycarboxylic acid mixtures to improve wet strength. Interfiber cross-linking to impart wet strength to paper pulps using polycarboxylic acids has also been described by Y. Yu, et. al., (Tappi Journal, 81(11), 159 (1998), and in PCT patent application WO98/13545 where aromatic polycarboxylic acids were used.

Interfiber crosslinking in sheet, board or pad form normally produces very large quantities of "knots" (and also "nits" which are a "knots" subfraction). Therefore, cross-linking a cellulosic structure in sheet form would be antithetical or contrary to the desired result, and indeed would be expected to maximize the potential for "knots" (and "nits") resulting in poor performance in the desired applications.

Accordingly, there exists a need for an economical cross-linking process that produces cross-linked fibers in sheet form which offer superior wet resiliency and fewer "knots" (and "nits") than current individualized cross-linking process. The present invention seeks to fulfill these needs and provides further related advantages.

III. Treatment with Caustic Solution

U.S. Pat. No. 3,932,209, incorporated by reference, describes the use of a "cold" caustic extraction process to remove hemicelluloses from cellulose fibers. Hemicelluloses are described as a group of gummy amorphous substances intermediate in composition between cellulose and the sugars. They are found on the cellulose fiber walls and include xylan, mannan, glucomannan, araban, galactan, arabogalactan, uronic acids, plant gums, and related polymers containing residues of L-rhamnose. During the cross-linking of cellulose fiber sheets, hemicelluloses contribute to a significant amount of undesirable interfiber cross-linking and knot formation. As such, U.S. Pat. No. 3,932,209 teaches that pulpboards containing more than 7% hemicellulose content are unacceptable since they will lead to the formation of cross-linked pulp with undesirable knot content greater than 15%.

In U.S. Pat. No. 6,620,293, incorporated by reference, it was discovered that mercerized cross-linked cellulose fiber sheets could be formed in a cost effective manner with low knot and nit levels and absorbency and wet resiliency properties comparable to fibers cross-linked in individualized or fluff form. The cellulose fibers were mercerized before a cross-linking agent was applied. By "mercerized", it is meant that the cellulose fibers, whether in sheet or individual form, were treated with a caustic solution (e.g., with sodium hydroxide) under mercerizing conditions. It is well known in the art that mercerizing conditions require treatment of the cellulose fibers at low temperature (i.e., 15–35° C.) and high caustic solution strengths (i.e., 10% sodium hydroxide strength or greater).

Treating cellulose pulp at mercerizing conditions (i.e., low temperature, high caustic concentration) and then cross-linking the cellulose fibers in sheet form suffers a cost disadvantage associated with the expense of mercerization. As such, there is a need for an even less expensive method for making cross-linked cellulose pulp sheets which are equivalent or superior to those currently known in the art.

SUMMARY OF THE INVENTION

In one aspect, the present invention provides a method for preparing cross-linked cellulosic fibers in sheet form, the method comprising applying a polymeric carboxylic acid cross-linking agent to a sheet of cellulosic fibers, said fibers having been treated with caustic solution under non-mercerizing conditions; and curing the cross-linking agent on said sheet of cellulosic fibers to form intrafiber cross-links.

In another aspect, the present invention provides a method of preparing a sheet of cross-linked cellulosic fibers having superior absorbency properties, the method comprising forming a wet laid sheet of cellulosic fibers, said fibers having been treated with a caustic solution under non-mercerizing conditions; applying a polymeric polycarboxylic acid cross-linking agent to said sheet of cellulosic fibers to form a sheet impregnated with the cross-linking agent; and curing the cross-linking agent on said impregnated sheet of cellulosic fibers to form intrafiber cross-links.

Another aspect of the present invention provides a composition comprising a wet laid sheet of cellulosic fibers, said cellulosic fibers having been treated with a caustic solution under non-mercerizing conditions and having substantial intrafiber cross-linking formed from the application of a polymeric polycarboxylic acid cross-linking agent. In one embodiment, the polymeric carboxylic acid cross-linking agent is an acrylic acid polymer and, in another embodiment, the polymeric carboxylic acid cross-linking agent is a maleic acid polymer.

In still another aspect, the present invention provides absorbent structures that contain the sheeted carboxylic acid cross-linked fibers of this invention, and absorbent constructs incorporating such structures.

Advantageously, the invention economically provides cross-linked fibers having good bulking characteristics, good porosity and absorption, low knots (and nits), and low fines.

DETAILED DESCRIPTION OF THE INVENTION

The present invention is directed to a method for forming chemically cross-linked cellulose fibers in sheet form with carboxylic acid cross-linking agents. Preferably, the cellulose pulp fibers have been treated with a caustic solution under non-mercerizing conditions and contain greater than 8% hemicellulose content.

A. Caustic Solution Treatment

The cellulose pulp fibers may be derived using any conventional methods from a softwood pulp source with starting materials such as various pines (Southern pine, White pine, Caribbean pine), Western hemlock, various spruces, (e.g., Sitka Spruce), Douglas fir or mixture of same and/or from a hardwood pulp source with starting materials such as gum, maple, oak, eucalyptus, poplar, beech, or aspen or mixtures thereof. Preferably, the cellulose fibers have not been subjected to any mechanical refining.

In the preferred embodiment, the cellulose pulp fibers are pretreated using any conventional methods to remove at least a portion of the hemicelluloses present before they are cross-linked in sheet form. The pretreatment may occur at anytime before the cross-linking step. Preferably, the hemicelluloses are extracted by treating the cellulose pulp fibers in caustic solution (i.e., caustic extraction) under non-mercerizing conditions. Non-mercerizing conditions include treatment with lower concentration caustic solution (i.e., less than 10% sodium hydroxide concentration) and/or at higher temperatures (i.e., greater than 35° C.) than known mercerizing parameters. For example, treatments of the cellulose pulp fibers can be performed with less than 10% caustic strength (i.e., equal to or less than 4%, 5%, 6%, 7%, 8%, or 9% caustic solution strength). Alternatively, the cellulose pulp fibers can be treated at temperatures exceeding 35° C. (e.g., equal to or greater than 40° C., 45° C., 50° C., 55° C., 60° C., 65° C., etc.).

By using lower strength caustic solutions to pretreat the cellulose fiber pulp, the present invention results in lower costs than other known methods. At the same time, treatment with lower strength caustic solution will yield non-mercerized cellulose fiber pulp having a higher hemicellulose content than that which previously have been found to be acceptable for sheet formed cross-linked absorbent structures (i.e., greater than the maximum 7% hemicellulose content disclosed in U.S. Pat. No. 3,932,209). However, as described herein, the inventors have unexpectedly discovered, contrary to the teachings in the art, that cross-linked cellulose pulp sheets with low knot and nit levels and excellent absorbency and wet resiliency properties can still be formed from non-mercerized cellulose fiber pulp with hemicellulose content far higher than the threshold level previously accepted in the art by using the present invention. For example, the cross-linked cellulosic fiber sheets of the present invention can be formed from cellulose pulp having greater than 7% or 8% hemicellulose content or greater than 10% hemicellulose content (e.g., equal to or greater than 11%, 12%, 13%, 14%, 15%, and so on). Preferably, the hemicellulose content of the cellulose fiber pulp is between 8–15%.

The non-mercerized cellulose fiber pulp is then formed into a sheet, pad or board using any known methods, such as air laying or wet laying in the conventional manner, for cross-linking.

B. Cross-Linking Agents

Cross-linking agents suitable for use in the invention include homopolymers, copolymers and terpolymers, alone or in combination, prepared with maleic anhydride as the predominant monomer. Molecular weights can range from about 400 to about 100,000 preferably about 400 to about 4,000. The homopolymeric polymaleic acids contain the repeating maleic acid chemical unit —[CH(COOH)—CH(COOH)]$_n$—, where n is 4 or more, preferably about 4 to about 40. In addition to maleic anhydride, maleic acid or fumaric acid may also be used.

As used herein, the term "polymeric carboxylic acid" refers to a polymer having multiple carboxylic acid groups available for forming ester bonds with cellulose (i.e., cross-links). Generally, the polymeric carboxylic acid cross-linking agents useful in the present invention are formed from monomers and/or comonomers that include carboxylic acid groups or functional groups that can be converted into carboxylic acid groups. Suitable cross-linking agents useful in forming the cross-linked fibers of the present invention include polyacrylic acid polymers, polymaleic acid polymers, copolymers of acrylic acid, copolymers of maleic acid, and mixtures thereof. Other suitable polymeric carboxylic acids include citric acid and commercially available polycarboxylic acids such as polyaspartic, polyglutamic, poly(3-hydroxy)butyric acids, and polyitaconic acids. As used herein, the term "polyacrylic acid polymer" refers to polymerized acrylic acid (i.e., polyacrylic acid); "copolymer of acrylic acid" refers to a polymer formed from acrylic acid and a suitable comonomer, copolymers of acrylic acid and low molecular weight monoalkyl substituted phosphinates, phosphonates, and mixtures thereof; the term "polymaleic acid polymer" refers to polymerized maleic acid (i.e., polymaleic acid) or maleic anhydride; and "copolymer of maleic acid" refers to a polymer formed from maleic acid (or maleic anhydride) and a suitable comonomer, copolymers of maleic acid and low molecular weight monoalkyl substituted phosphinates, phosphonates, and mixtures thereof.

Polyacrylic acid polymers include polymers formed by polymerizing acrylic acid, acrylic acid esters, and mixtures thereof. Polymaleic acid polymers include polymers formed by polymerizing maleic acid, maleic acid esters, maleic anhydride, and mixtures thereof. Representative polyacrylic and polymaleic acid polymers are commercially available from Vinings Industries (Atlanta, Ga.) and BioLab Inc. (Decatur, Ga.).

Acceptable cross-linking agents of the invention are addition polymers prepared from at least one of maleic and fumaric acids, or the anhydrides thereof, alone or in combination with one or more other monomers copolymerized therewith, such as acrylic acid, methacrylic acid, crotonic acid, itaconic acid, aconitic acid (and their esters), acrylonitrile, acrylamide, vinyl acetate, styrene, a-methylstyrene, methyl vinyl ketone, vinyl alcohol, acrolein, ethylene and propylene. Polymaleic acid polymers ("PMA polymers") useful in the present invention and methods of making the same are described, for example, in U.S. Pat. Nos. 3,810,834, 4,126,549, 5,427,587 and WO 98/30387, all of which are incorporated by reference. In a preferred embodiment, the PMA polymer is the hydrolysis product of a homopolymer of maleic anhydride. In other embodiments of the invention, the PMA polymer is a hydrolysis product derived from a copolymer of maleic anhydride and one of the monomers listed above. Another preferred PMA polymer is a terpolymer of maleic anhydride and two other monomers listed above. Maleic anhydride is the predominant monomer used in preparation of the preferred polymers. The molar ratio of maleic anhydride to the other monomers is typically in the range of about 2.5:1 to 9:1.

Preferably, the polymaleic acid polymers have the formula:

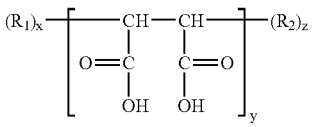

wherein $R_1$, and $R_2$ independently are H, $C_1$–$C_5$ alkyl, substituted or unsubstituted, or aryl, and x and z are positive rational number or 0, y is a positive rational number and x+y+z=1; y is generally greater than 0.5, i.e. greater than 50% of the polymer. In many instances it is desired that y be less than 0.9, i.e. 90% of the polymer. A suitable range of y, therefore, is about 0.5 to about 0.9. Alkyl, as used herein, refers to saturated, unsaturated, branched and unbranched alkyls. Substituents on alkyl or elsewhere in the polymer include, but are not limited to carboxyl, hydroxy, alkoxy, amino, and alkylthiol substituents. Polymers of this type are described, for example, in WO 98/30387 which is herein incorporated by reference.

Polymaleic acid polymers suitable for use in the present invention have number average molecular weights of at least 400, and preferably from about 400 to about 100,000. Polymers having an average molecular weight from about 400 to about 4000 are more preferred in this invention, with an average molecular weight from about 600 to about 1400 most preferred. This contrasts with the preferred range of 40,000–1,000,000 for interfiber cross-linking of paper-type cellulosics to increase wet strength (see, e.g., WO 98/30387 of C. Yang, p. 7; and C. Yang, TAPPI JOURNAL, incorporated by reference).

Non-limiting examples of polymers suitable for use in the present invention include, e.g., a straight chain homopolymer of maleic acid, with at least 4 repeating units and a molecular weight, e.g., of at least 400; a terpolymer with maleic acid predominating, with molecular weight of at least 400.

In one embodiment, the present invention provides cellulose fibers that are cross-linked in sheet form with a blend of cross-linking agents that include the polymaleic or polyacrylic acids described herein, and a second cross-linking agent. Preferred second cross-linking agents include polycarboxylic acids, such as citric acid, tartaric acid, maleic acid, succinic acid, glutaric acid, citraconic acid, maleic acid (and maleic anhydride), itaconic acid, and tartrate monosuccinic acid. In more preferred embodiments, the second cross-linking agent is citric acid or maleic acid (or maleic anhydride). Other preferred second cross-linking agents include glyoxal and glyoxylic acid.

A solution of the polymers is used to treat the cellulosic material. The solution is preferably aqueous. The solution includes carboxylic acids in an amount from about 2 weight percent to about 10 weight percent, preferably about 3.0 weight percent to about 6.0 weight percent. The solution has a pH preferably from about 1.5 to about 5.5, more preferably from about 2.5 to about 3.5.

The fibers, for example in sheeted or rolled form, preferably formed by wet laying in the conventional manner, are treated with the solution of crosslinking agent, e.g., by spraying, dipping, impregnation or other conventional application method so that the fibers are substantially uniformly saturated.

A cross-linking catalyst is applied before curing, preferably along with the carboxylic acids. Suitable catalysts for cross-linking include alkali metal salts of phosphorous containing acids such as alkali metal hypophosphites, alkali metal phosphites, alkali metal polyphosphonates, alkali metal phosphates, and alkali metal sulfonates. A particularly preferred catalyst is sodium hypophosphite. A suitable ratio of catalyst to carboxylic acids is, e.g., from 1:2 to 1:10, preferably 1:4 to 1:8.

Process conditions are also intended to decrease the formation of fines in the final product. In one embodiment, a sheet of wood pulp in a continuous roll form, is conveyed through a treatment zone where cross-linking agent is applied on one or both surfaces by conventional means such as spraying, rolling, dipping or other impregnation. The wet, treated pulp is then dried. It is then cured to effect cross-linking under appropriate thermal conditions, e.g., by heating to elevated temperatures for a time sufficient for curing, e.g. from about 175° C. to about 200° C., preferably about 185° C. for a period of time of about 5 min. to about 30 min., preferably about 10 min. to about 20 min., most preferably about 15 min. Curing can be accomplished using a forced draft oven.

Drying and curing may be carried out, e.g., in hot gas streams such as air, inert gases, argon, nitrogen, etc. Air is most commonly used.

The cross-linked fibers of the present invention can be characterized as having absorbency under load (AUL) of greater than about 8.0 g/g, preferably greater than about 8.5 g/g or more preferably greater than about 9.0 g/g. AUL measures the ability of the fiber to absorb fluid against a restraining or confining force over a period of time. Additionally, the adsorbent capacity (CAP) of these fibers can be greater than 9.0 g/g, preferably greater than about 10.0 g/g or more preferably greater than about 11.0 g/g. CAP measures the ability of the fiber to retain fluid with no or very little restraining pressure. Alternatively, the fibers of the present invention can be characterized as having a centrifuge retention capacity (CRC) of less than about 0.6 g/g, preferably less than about 0.58 g/g, or more preferably less than about 0.55 g/g. The methodology used to measure these properties is outlined in the Examples which follow.

C. Uses and Applications

Resulting cross-linked fibrous material prepared according to the invention can be used, e.g., as a bulking material, in high bulk specialty fiber applications which require good absorbency and porosity. The cross-linked fibers can be used, for example, in non-woven, fluff absorbent applications. The fibers can be used independently, or preferably incorporated into other cellulosic materials to form blends using conventional techniques. Air laid techniques are generally used to form absorbent products. In an air laid process, the fibers, alone or combined in blends with other fibers, are blown onto a forming screen. Wet laid processes may also be used, combining the cross-linked fibers of the invention with other cellulosic fibers to form sheets or webs of blends. Various final products can be made including acquisition layers or absorbent cores for diapers, feminine hygiene products, and other absorbent products such as meat pads or bandages; also filters, e.g., air laid filters containing 100% of the cross-linked fiber composition of the invention. Towels and wipes also can be made with the fibers of the invention or blends thereof. Blends can contain a minor amount of the cross-linked fiber composition of the invention, e.g., from about 5% to about 40% by weight of the cross-linked composition of the invention, or less than 20 wt. %, preferably from about 5 wt. % to about 10 wt. % of the cross-linked composition of the invention, blended with a major amount, e.g., about 95 wt. % to about 60 wt. %, of uncross-linked wood pulp material or other cellulosic fibers, such as standard paper grade pulps.

As noted above, due to a higher hemicellulose content, cross-linking a cellulosic structure in sheet form comprising fibers which have been treated under non-mercerizing conditions would be expected to increase interfiber cross-linking, leading to "nits" and "knots" resulting in poor performance in the desired application. Thus, it was unexpected to find that cross-linking cellulosic pulp fibers treated with caustic under non-mercerizing conditions in sheet form in accordance with the present invention yielded a "knots" content ("nits" are a sub-component of the total "knot" content) comparable to those of cellulosic pulp fibers cross-linked in individualized fiber form such as the commercial cross-linked pulp product of the Weyerhaeuser Company commonly referred to as HBA (for "high-bulk additive") and a cross-linked pulp utilized in absorbent products by Proctor & Gamble ("P&G"), both of which are products cross-linked in "individualized" fibrous form using standard fluff pulps to minimize interfiber cross-linking.

In absorbency tests, which determine whether the fibers are suitable for certain applications such as diaper acquisition layer (AL) where absorbency performance is important, it was observed that cross-linked cellulosic pulp fibers which have been treated with caustic under non-mercerizing conditions in accordance with the present invention yielded comparable absorbent performance results to cross-linked mercerized cellulosic pulp fibers. It was further observed that the absorbency performance of the cellulosic pulp fiber products prepared in accordance with the present invention was comparable or superior to the Weyerhaeuser HBA and P&G commercial pulp products which were cross-linked in individualized fiber form.

Thus, another highly important benefit of the present invention is that cross-linked cellulosic pulp products made in accordance with the invention enjoy the same or better performance characteristics as conventional individualized cross-linked cellulose fibers, but avoid the handling and processing problems associated with dusty individualized cross-linked fibers.

The invention will be illustrated but not limited by the following examples:

EXAMPLES

Terms used in the examples are defined as follows:

Rayfloc®-J-LD (low density) is untreated southern pine kraft pulp sold by Rayonier Performance Fibers Division (Jesup, Ga. and Fernandina Beach, Fla.) for use in products requiring good absorbency, such as absorbent cores in diapers.

Belclene® DP-80 (BioLab Industrial Water Additives Division, Decatur, Ga.) is a mixture of polymaleic acid terpolymer with the maleic acid monomeric unit predominating (molecular weight of about 1000) and citric acid.

Example 1

Conventional kraft fluff grade pulp (i.e., Rayfloc-J) was treated with a caustic extraction stage at 25° C. using 16%, 10%, and 7% sodium hydroxide, respectively, incorporated into its normal bleach sequence (conventional techniques well understood by those in the trade). These pulps were then wet laid and formed into pulp sheets with densities of 0.44–0.46 g/cc using known conventional mill production methods.

The pulp sheets were cross-linked with a cross-linking agent (i.e., 4.8–4.9% of Belclene® DP-80) as follows. Dry pulp sheets, made as described above, were dipped into solutions of DP-80 at pH of 3.0 (solutions contained 1:6 parts by weight of sodium hypophosphite monohydrate catalyst to DP-80 solids). The sheets were then blotted and mechanically pressed to consistencies ranging from 46–47% prior to weighing. From the amount of solution remaining with the pulp sheet, the amount of DP-80 chemical on oven-dried ("o.d.") pulp can be calculated. The sheets were then transferred to a tunnel dryer to air dry overnight at about 50° C. and 17% relative humidity. The individual, air-dried pulp sheets were then placed into a forced draft oven at about 188° C. for 15 minutes to cure (i.e. cross-link) them with DP-80. The samples made with the 16%, 10% and 7% caustic extracted pulps are referenced hereinafter as, respectively, R-16, R-10 and R-7.

A. Absorbency Test

Using the absorbency test method described in the following paragraph, the absorbency under load (AUL), the absorbent capacity (CAP), and the centrifuge retention capacity (CRC) values were determined on the cross-linked fiber products of present invention (made from R-7 pulp fibers), and compared with other cross-linked fiber products (made from R-10 and R-16 pulp fibers), including two cross-linked commercial products: P&G's "stiffened twisted curly" (STC) fiber used as an acquisition layer (AL) in Pampers®; and Weyerhaeuser's HBA (high-bulk additive) fiber-both of these commercial products are fibers cross-linked in individualized fiber form. This test method is predictive of performance in AL applications, with the CRC value being most important since it is a measurement of the fiber's ability to resist wet collapse under load (i.e., wet resiliency).

The absorbency test was carried out in a one inch inside diameter plastic cylinder having a 100-mesh metal screen adhering to the cylinder bottom "cell", containing a plastic spacer disk having a 0.995 inch diameter and a weight of about 4.4 g. In this test, the weight of the cell containing the spacer disk was determined to the nearest 0.0001 g, and the spacer was then removed from the cylinder and about 0.35 g of cross-linked fibers having a moisture content within the range of about 4% to about 8% by weight were air-laid into the cylinder. The spacer disk was then inserted back into the cylinder on the fiber, and the cylinder group was weighed to the nearest 0.0001 g. The fiber in the cell was next compressed with a load of 4 psi for 60 seconds; the load was then removed and the fiber pad allowed to equilibrate for 60 seconds. The pad thickness was measured, and the result used to calculate the dry bulk of the cross-linked fiber.

A load of 0.3 psi was then applied to the fiber pad by placing a 100 g weight on top of the spacer disk, and the pad was allowed to equilibrate for 60 seconds, after which the pad thickness was measured. The cell and its contents were next hung in a Petri dish containing a sufficient amount of saline solution (0.9% by weight saline) to touch the bottom of the cell. The cell was allowed to stand in the Petri dish for 10 minutes, and then removed and hung in another empty Petri dish and allowed to drip for 30 seconds. While the pad was still under load, its thickness was measured. The 100 g weight was then removed and the weight of the cell and contents was determined. The weight of the saline solution absorbed per gram of fiber was then determined and expressed as the absorbency under load (g/g).

The absorbent capacity of the cross-linked fiber was determined in the same manner as the test used to determine absorbency under load above, except that this experiment was carried out under a load of 0.01 psi. The results are used to determine the weight of the saline solution absorbed per gram of fiber, and expressed as the absorbent capacity (g/g).

The cell from the absorbent capacity experiment was then centrifuged for 3 min at 1400 rpm (Centrifuge Model HN, International Equipment Co., Needham Heights, Mass.—USA), and weighed. The results obtained were used to calculate the weight of saline solution retained per gram of fiber, and expressed as the centrifuge retention capacity (g/g).

Results are summarized in Table 1.

TABLE 1

Absorbency Test Results for DP-80 Cross-Linked Rayfloc Pulps Extracted with 7%, 10% & 16% NaOH (designated as R-7, R-10 & R-16 below)

| Sample | AUL (0.3 psi), g/g | CAP, g/g | CRC, g/g |
|---|---|---|---|
| Cross-Linked R-16 | 10.2 | 12.3 | 0.46 |
| Cross-Linked R-10 | 10.4 | 11.7 | 0.47 |
| Cross-Linked R-7 | 9.5 | 11.9 | 0.51 |
| P&G STC | 10.8 | 12.4 | 0.58 |
| Weyerhaeuser HBA | 10.9 | 13.2 | 0.62 |

As shown in Table 1, the cross-linked fibers prepared in accordance with the present invention (R-7) compared favorably with other known cross-linked pulp fibers. For example, even though the CRC value for the cross-linked, non-mercerized R-7 fibers of the present invention was slightly greater than CRC values of their cross-linked counterparts from the more purified and mercerized R-10 and R-16 pulps, it was also well below that of the CRC value for the P&G STC and Weyerhaueser HBA fiber products, confirming the suitability of cross-linked sheet products derived from the R-7 fibers for AL applications.

B. Hemicellulose Content

Alpha (α)-cellulose and hemicellulose contents for the R-16, R-10 and R-7 fibers were measured and the results are presented in Table 2. Specifically, analysis was performed for the two hemicellulose sugars, xylose and mannose. There are three main steps in wood sugar analysis: hydrolysis, separation and detection. In the method employed, the hemicellulose carbohydrates present in pulp are hydrolyzed to their respective sugar monomers in two stages prior to chromatographic analysis using High pH Anion Exchange Chromatography with Pulsed Amperometric Detection (HPAEC/PAD), which is a commonly used method for sugars analysis [e.g., R. D. Rocklin & C. A. Pohl "Determination of Carbohydrates by Anion Exchange Chromatography with Pulsed Amperometric Detection." *J. Liquid Chromatography,* 6(9), pp.1577–1590 (1983); J. J. Worrall & K. M. Anderson. "Sample Preparation for Analysis of Wood Sugars by Anion Chromatography." *J. Wood Chem. and Tech.,* 13(3), pp. 429–437 (1993).] A detailed description of this particular HPAEC/PAD method using a sodium acetate/sodium hydroxide ($NaCO_2CH_3$/NaOH) wash eluent is found in M. W. Davis. "A Rapid Modified Method for Compositional Carbohydrate Analysis of Lignocellulosics by High pH Anion-Exchange Chromatography with Pulsed Amperometric Detection (HPAEC/PAD)." *J. Wood Chem. and Tech.,* 18(2), pp. 235–252 (1998). All of above documents are incorporated by reference.

During sample preparation, the samples were subjected to two stages of hydrolysis. Pulp samples (0.355±0.005 g) were first treated with 72% w/w sulfuric acid (3.0 mL) for 60 minutes at 30.0° C. To minimize the reversion of the monomers to oligomers, after one hour the sample in 72% sulfuric acid was diluted with 84 mL of deionized (≧18.0 MΩ) water and the diluted sample was heated for 20 min at 120° C. (15 psi) in an autoclave. After cooling, the samples were filtered with 0.45 micron ion chromatography filters and further diluted for the chromatographic analysis.

Chromatographic analyses by HPAEC/PAD were conducted using a Dionex DX 500 ion chromatography system with a CarboPac PA1 (Dionex) analytical column, a GP40 gradient pump for the separation eluent (water) and the column wash eluent (170 mM $NaCO_2CH_3$ in 200 mM NaOH), a PC10 Pneumatic Controller for the post-column mobile phase (300 mM NaOH), and a Dionex ED40 electrochemical detector.

The results are presented in Table 2.

TABLE 2

| Sample | α-Cellulose, %[a] | Xylose, % | Mannose, % | Total Hemicellulose Sugars, %[b] |
|---|---|---|---|---|
| R-16 | 97.0 | 2.8 | 4.8 | 7.6 |
| R-10 | 97.0 | 2.0 | 5.7 | 7.7 |
| R-7 | 94.0 | 3.1 | 8.0 | 11.1 |

[a]α-cellulose content is an intermediate value based on the insolubility, expressed as "R" in 10 and 18% NaOH [i.e., α-cellulose = ½ ($R_{10}$ + $R_{18}$)]. See Rydholm, S. A., "Pulping Processes," pp. 91, 1117, Interscience Publishers, New York (1965).
[b]Xylose + mannose.

As shown in Table 2, the cellulosic fibers of the present invention (i.e., R-7) have far higher hemicellulose content due to the use of a lower strength caustic solution. At the same time, this result, viewed in conjunction with Table 1, confirms, contrary to the teachings of the prior art, that the present invention will yield viable cross-linked fibers having acceptable AUL, CAP, and CRC values even though they have higher hemicellulose content than the threshold level accepted in the prior art (i.e., greater than 7%).

C. Knot Content

To further confirm the viability of the cross-linked fibers of the present invention, the knot content of the R-7 product was measured and compared to existing commercial products using the Johnson Fiber Classification. Specifically, a sample in fluff form was continuously dispersed in an air stream. During dispersion, loose fibers passed through a 14 mesh screen (1.18 mm) and then through a 42 mesh (0.2 mm) screen. Pulp bundles (knots) which remained in the dispersion chamber and those that were trapped on the 42 mesh screen were removed and weighed. The former are called "knots" and the latter "accepts". The combined weight of these two is subtracted from the original weight to determine the weight of fibers that passed through the 0.2 mm screen. These fibers are referred to as "fines".

The results are presented in Table 3.

TABLE 3

| Sample | % Knots | % Accepts | % Fines |
|---|---|---|---|
| Cross-Linked R-7 | 10.0 | 84.0 | 6.0 |
| P&G STC | 13.8 | 80.3 | 5.9 |
| Weyerhaueser HBA | 11.9 | 82.1 | 6.0 |

The data set forth in Table 3 confirmed that even though the cross-linked fibers of the present invention contained higher hemicellulose content than the upper limit accepted in the art, the DP-80 cross-linked R-7 sheet product nevertheless contained "knot" contents well below the established 15% threshold limit. This result thus further confirmed that the cross-linking chemistry employed in the present invention surprisingly enables the use of high hemicellulose containing pulp sheets or boards as a feedstock for cross-linking.

Additionally, Table 3 also confirmed that the DP-80 cross-linked product derived from R-7 fibers contained less "knots" than either of the commercial P&G STC and Weyerhaueser HBA fiber products. The "fines" levels were also comparable.

Example 2

Example 1 was repeated, except that the Rayfloc feedstock was pretreated/purified at the cold caustic extraction stage with 4% NaOH solution at 25° C. before cross-linking in sheet form with DP-80.

A. Hemicellulose Content

Using the procedure described in Example 1, the α-cellulose and hemicellulose content of this sample was measured. The results are presented in Table 4.

TABLE 4

| Sample | α-Cellulose, % | Xylose, % | Mannose, % | Total Hemicellulose Sugars, %[a] |
|---|---|---|---|---|
| R-4 | 90.8 | 6.0 | 8.0 | 14.0 |

[a]Xylose + mannose

The date shown in Table 4 confirmed that R-4, having been treated with a lower strength caustic solution under non-mercerizing conditions, contained even higher hemicellulose content and thus, lower α-cellulose content, than R-7.

B. Absorbency Test

Sheets formed from R-4 fibers cross-linked with DP-80 (5.8%) in the manner described in Example 1 were placed in wet form after pressing into an oven set at 209° C. to simultaneously dry and cure for a total time of 6 minutes. This resulted in a product which, despite its high hemicellulose content, was unexpectedly comparable or superior to known commercial products. Specifically, the absorbency test results for R-4 fibers are set forth below in Table 5 in comparison with the previous results obtained for the for DP-80 cross-linked R-7 product, and the two commercial cross-linked products (P&G and Weyenhaueser).

TABLE 5

| Sample | AUL (0.3 psi), g/g | CAP, g/g | CRC, g/g |
|---|---|---|---|
| Cross-Linked R-7 | 9.5 | 11.9 | 0.51 |
| Cross-Linked R-4 | 9.9 | 11.0 | 0.56 |

TABLE 5-continued

| Sample | AUL (0.3 psi), g/g | CAP, g/g | CRC, g/g |
|---|---|---|---|
| P&G STC | 10.8 | 12.4 | 0.58 |
| Weyerhaeuser HBA | 10.9 | 13.2 | 0.62 |

The data in Table 5 confirmed that cross-linked R-4 fibers have comparable AUL, CAP and CRC values with that of cross-linked R-7. Since the R-4 product yielded better CRC value than the P&G and Weyerhaueser commercial products, such results indicate that cross-linked R-4 cellulosic pulp fibers are commercially viable.

The results in Tables 1 & 5 reveal that CRC values increase as the caustic extraction strength is diminished (i.e., from 16 to 4% NaOH concentration). Also, as purity decreases with lower caustic extraction strength (e.g., higher hemicellulose content of the starting sheet stock), the product color can become an issue. However, in many end-use applications, color is not an impediment, and also it can be controlled by more attention to temperature control during curing.

C. Knot Content

Using the Johnson Classification result procedures described in Example 1, the knot content of the R-4 product was measured and compared to the other cellulosic pulp fiber products. The results are displayed in Table 6.

TABLE 6

| Sample | % Knots | % Accepts | % Fines |
|---|---|---|---|
| Cross-Linked R-7 | 10.0 | 84.0 | 6.0 |
| Cross-Linked R-4 | 56.9 | 38.6 | 4.5 |
| P&G STC | 13.8 | 80.3 | 5.9 |
| Weyerhaueser HBA | 11.9 | 82.1 | 6.0 |

As shown in Table 6, the knot content of the fluff from cross-linked R-4 product was higher than that of the R-7 product, and substantially higher than the 15% knot content threshold established in the art for product viability. Surprisingly, however, despite significantly exceeding this threshold, Table 5 confirms that the R-4 fibers are still commercially viable. It is believed that the low level of "fines" content may explain this surprising result. For example, as a result of the processes employed in the present invention, the R-4 fibers are not as brittle as other fibers and thus, do not lead to higher fines content upon fluffing, which consequently compromises absorbent performance.

Nevertheless, due to the high "knot" content of the R-4 product, an absorbent fluff product with too many "knots" can be aesthetically unfavorable for certain uses, and can cause difficulty when attempting to air lay them uniformity into selected products.

Example 3

Using the procedure described in Example 1, Rayfloc stock pulp was subjected to caustic extraction with 7% NaOH at 65° C. and subsequently cross-linked in sheet form using 6.0% DP-80, except that after pressing, the wet sample was placed in an oven set at an average temperature of 198° C. to simultaneously dry and cure for a total time of 4.5 minutes. This sample is referred to as "R-7-65° C."

A. Hemicellulose Content

Following the methodology outlined in Example 1, hemicellulose sugar and α-cellulose content of the R-7-65° C.

fiber was measured and compared to the R-7 sample from Example 1 (hereinafter, "R-7-25° C."). The results are displayed in Table 7.

TABLE 7

| Sample | α-Cellulose, % | Xylose, % | Mannose, % | Total Hemicellulose Sugars, %[a] |
|---|---|---|---|---|
| R-7-65° C. | 91.9 | 5.0 | 8.5 | 13.5 |
| R-7-25° C. | 94.0 | 3.1 | 8.0 | 11.1 |

[a]Xylose + mannose.

As shown in Table 7, the hemicellulose content of R-7-65° C. is higher (and consequently the sample is less pure) than R-7-25° C.

B. Absorbency Test

The AUL, CAP, and CRC values of the R-7-65° C. pulp product was measured using the methodology described in Example 1 and compared to previously measured products. The results are presented in Table 8.

TABLE 8

| Sample | AUL (0.3 psi), g/g | CAP, g/g | CRC, g/g |
|---|---|---|---|
| Cross-Linked R-7-65° C. | 9.2 | 10.7 | 0.53 |
| Cross-Linked R-7-25° C. | 9.5 | 11.9 | 0.51 |
| P&G STC | 10.8 | 12.4 | 0.58 |
| Weyerhaeuser HBA | 10.9 | 13.2 | 0.62 |

The results in Table 8 confirmed that even though the R-7-65° C. product is less pure (i.e., has higher hemicellulose content), the R-7-65° C. fibers still yield comparable absorbency properties compared to the R-7-25° C. fibers and the two commerical products (P&G and Weyerhaueser).

C. Knot Content

The knot content of the R-7-65° C. product was measured using the methodology described in Example 1 and compared to the previously measured commercial products. The results are presented in Table 9.

TABLE 9

| Sample | % Knots | % Accepts | % Fines |
|---|---|---|---|
| Cross-Linked R-7-65° C. | 11.2 | 81.8 | 7.0 |
| P&G STC | 13.8 | 80.3 | 5.9 |
| Weyerhaueser HBA | 11.9 | 82.1 | 6.0 |

These Johnson Fiber Classification results confirm that the "knots" content level of the cross-linked product derived from the R-7-65° C. fibers is acceptable (well below the 15% threshold taught by the prior art); and is as good as or better than the two commercial P&G and Weyerhaueser products.

While there have been described what are presently believed to be the preferred embodiments of the invention, those skilled in the art will recognize that changes and modifications may be made thereto without departing from the spirit of the invention, and it is intended to claim all such changes and modifications as fall within the true scope of the invention.

We claim:

1. A method for preparing cross-linked cellulosic fibers in sheet form having less than 15% by weight knots, the method comprising:

(a) treating cellulosic fibers with a caustic solution under non-mercerizing conditions to make caustic treated cellulosic fibers with a hemicellulose content greater than 8%;

(b) forming said caustic treated cellulosic fibers into a sheet;

(c) applying a polymeric carboxylic acid cross-linking agent to said sheet of caustic treated cellulosic fibers; and (d) curing the cross-linking agent on said sheet of caustic treated cellulosic fibers to form a sheet of caustic treated fibers with intrafiber cross-links and less than 15% by weight knots.

2. The method of claim 1, wherein the hemicellulose content of the cellulosic fibers is greater than 10%.

3. The method of claim 1, wherein the hemicellulose content of the cellulosic fibers is between 8–15%.

4. The method of claim 1, wherein the sheet produced in step (c) is dried prior to step (d).

5. The method of claim 1, wherein the fibers have been treated with less than 10% caustic solution strength.

6. The method of claim 1, wherein the fibers have been treated with less than 8% caustic solution strength.

7. The method of claim 1, wherein the polymeric carboxylic acid cross-linking agent comprises a homopolymer of maleic acid monomer, a copolymer of maleic acid monomer, a terpolymer of maleic acid monomer or a mixture thereof.

8. The method of claim 7, wherein the polymeric carboxylic acid cross-linking agent has an average molecular weight from about 400 to about 10000.

9. The method of claim 7, wherein the polymeric carboxylic acid cross-linking agent has an average molecular weight from about 400 to about 4000.

10. The method of claim 7, wherein the polymeric carboxylic acid cross-linking agent has a pH from about 1.5 to about 5.5.

11. The method of claim 7, wherein the polymeric carboxylic acid cross-linking agent has a pH from about 2.5 to about 3.5.

12. The method of claim 1, wherein the fibers in said sheet of caustic treated cellulosic fibers with intrafiber cross-links have an absorbency under load greater than about 8.0 g/g.

13. The method of claim 1, wherein the fibers in said sheet of caustic treated cellulosic fibers with intrafiber cross-links have an absorbency under load greater than about 9.0 g/g.

14. The method of claim 1, wherein the fibers in said sheet of caustic treated cellulosic fibers with intrafiber cross-links have an absorbent capacity greater than about 9.0 g/g.

15. The method of claim 1, wherein the fibers in said sheet of caustic treated cellulosic fibers with intrafiber cross-links have an absorbent capacity greater than about 10.0 g/g.

16. The method of claim 1, wherein the fibers in said sheet of caustic treated cellulosic fibers with intrafiber cross-links have a centrifuge retention capacity less than about 0.6 g/g.

17. The method of claim 1, wherein the fibers in said sheet of caustic treated cellulosic fibers with intrafiber cross-links have a centrifuge retention capacity less than about 0.55 g/g.

18. A method of preparing a sheet of cross-linked cellulosic fibers having superior absorbency properties and less than 15% by weight knots, the method comprising:

(a) treating cellulose fibers with a caustic solution under non-mercerizing conditions to make caustic treated cellulose fibers with a hemicellulose content greater than 8%;

(b) forming a wet laid sheet of said caustic treated cellulosic fibers;

(c) applying a polymeric polycarboxylic acid cross-linking agent to said sheet of caustic treated cellulosic fibers to form a sheet of caustic treated cellulosic fibers impregnated with the cross-linking agent; and (d) curing the cross-linking agent on said impregnated sheet of caustic treated cellulosic fibers to form intrafiber cross-links and less than 15% by weight knots.

19. The method of claim 18, wherein the impregnated sheet produced in step (c) is dried prior to step (d).

20. The method of claim 18, wherein the hemicellulose content of the caustic treated cellulosic fibers is greater than 10%.

21. The method of claim 18, wherein the hemicellulose content of the caustic treated cellulosic fibers is between 8–15%.

22. The method of claim 18, wherein the cellulosic fibers have been treated with less than 10% caustic solution strength.

23. The method of claim 18, wherein the cellulosic fibers have been treated with less than 8% caustic solution strength.

24. The method of claim 18, wherein the polymeric carboxylic acid cross-linking agent comprises a homopolymer of maleic monomer, a copolymer of maleic acid monomer, a terpolymer of maleic acid monomer, or a mixture thereof.

25. The method of claim 24, wherein the polymeric carboxylic acid cross-linking agent has an average molecular weight from about 400 to about 4000.

26. The method of claim 24, wherein the polymeric carboxylic acid cross-linking agent has a pH from about 1.5 to about 5.5.

27. The method of claim 24, wherein the polymeric carboxylic acid cross-linking agent has a pH from about 2.5 to about 3.5.

28. The method of claim 18, wherein the fibers in said sheet of caustic treated cellulose fibers with intrafiber cross-links have an absorbency under load greater than about 8.0 g/g.

29. The method of claim 18, wherein the fibers in said sheet of caustic treated cellulose fibers with intrafiber cross-links have an absorbency under load greater than about 9.0 g/g.

30. The method of claim 18, wherein the fibers in said sheet of caustic treated cellulose fibers with intrafiber cross-links have an absorbent capacity greater than about 9.0 g/g.

31. The method of claim 18, wherein the fibers in said sheet of caustic treated cellulose fibers with intrafiber cross-links have an absorbent capacity greater than about 10.0 g/g.

32. The method of claim 18, wherein the fibers in said sheet of caustic treated cellulose fibers with intrafiber cross-links have a centrifuge retention capacity less than about 0.6 g/g.

33. The method of claim 18, wherein the fibers in said sheet of caustic treated cellulose fibers with intrafiber cross-links have a centrifuge retention capacity less than about 0.55 g/g.

34. A composition comprising a wet laid sheet of cellulosic fibers having a hemicellulose content greater than 8% and less than 15% by weight knots, said cellulosic fibers having been treated with a caustic solution under non-mercerizing conditions and having substantial intrafiber cross-linking formed from the application of a polymeric polycarboxylic acid cross-linking agent.

35. The composition of claim 34, wherein the hemicellulose content of the cellulosic fibers is greater than 10%.

36. The composition of claim 34, wherein the hemicellulose content of the cellulosic fibers is between 8–15%.

37. The composition of claim 34, wherein the cellulosic fibers have been treated with less than 10% caustic solution strength.

38. The composition of claim 34, wherein the cellulosic fibers have been treated with less than 8% caustic solution strength.

39. The composition of claim 34, wherein the polymeric carboxylic acid cross-linking agent comprises a homopolymer of maleic acid monomer, a copolymer of maleic acid monomer, a terpolymer of maleic acid monomer, or a mixture thereof.

40. The composition of claim 39, wherein the polymeric carboyxlic acid cross-linking agent has an average molecular weight from about 400 to about 4000.

41. The composition of claim 39, wherein the polymeric carboxylic acid cross-linking agent has a pH from about 1.5 to about 5.5.

42. The composition of claim 39, wherein the polymeric carboxylic acid cross-linking agent has a pH from about 2.5 to about 3.5.

43. The composition of claim 34, wherein said caustic treated cellulosic fibers are cross-linked while they are in said sheet form.

44. The composition of claim 34, wherein the fibers in said sheet of caustic treated cellulosic fibers with intrafiber cross-links have an absorbency under load greater than about 8.0 g/g.

45. The composition of claim 34, wherein the fibers in said sheet of caustic treated cellulosic fibers with intrafiber cross-links have an absorbency under load greater than about 9.0 g/g.

46. The composition of claim 34, wherein the fibers in said sheet of caustic treated cellulosic fibers with intrafiber cross-links have an absorbent capacity greater than about 9.0 g/g.

47. The composition of claim 34, wherein the fibers in said sheet of caustic treated cellulosic fibers with intrafiber cross-links have an absorbent capacity greater than about 10.0 g/g.

48. The composition of claim 34, wherein the fibers in said sheet of caustic treated cellulosic fibers with intrafiber cross-links have a centrifuge retention capacity less than about 0.6 g/g.

49. The composition of claim 34, wherein the fibers in said sheet of caustic treated cellulosic fibers with intrafiber cross-links have a centrifuge retention capacity less than about 0.55 g/g.

* * * * *